United States Patent [19]
Skoll

[11] 3,992,211
[45] Nov. 16, 1976

[54] ELECTROLESS PLATING COMPOSITION

[75] Inventor: Merceline L. Skoll, Milwaukee, Wis.

[73] Assignee: Trans-Metals Corporation, Milwaukee, Wis.

[22] Filed: June 11, 1971

[21] Appl. No.: 152,412

Related U.S. Application Data

[63] Continuation-in-part of Ser. No. 742,492, July 15, 1968, which is a continuation-in-part of Ser. No. 462,758, June 9, 1965, abandoned, which is a continuation-in-part of Ser. No. 374,845, June 12, 1964, abandoned.

[52] U.S. Cl. ..... 106/1; 252/79.1; 427/305; 427/437; 427/438

[51] Int. Cl.[2] ..... C23C 3/02

[58] Field of Search ..... 106/1; 204/29, 30; 252/79.1, 79.4, 80, 82, 86, 87; 427/305, 437, 438

[56] References Cited

UNITED STATES PATENTS

| | | | |
|---|---|---|---|
| 2,692,187 | 10/1954 | Chester et al. | 252/79.4 |
| 3,032,436 | 5/1962 | Gostin et al. | 106/1 X |
| 3,230,098 | 1/1966 | Robinson | 106/1 |
| 3,246,995 | 4/1966 | Moore | 106/1 |
| 3,365,380 | 1/1968 | Shibasaki | 252/79.4 X |
| 3,389,065 | 6/1968 | Shibasaki et al. | 252/79.4 X |
| 3,403,035 | 9/1968 | Schneble et al. | 106/1 |

*Primary Examiner*—Lorenzo B. Hayes
*Attorney, Agent, or Firm*—Andrus, Sceales, Starke & Sawall

[57] ABSTRACT

A method of surface treatment of a metallic base material, and particularly, a method of electroless plating in which the base material to be plated is immersed in an aqueous solution containing a water soluble metal salt, an acid component selected from the group consisting of gluconic acid, glucono delta lactone and a water soluble salt of gluconic acid, and a high concentration of a hydrolyzed carbohydrate. The high concentration of carbohydrate in combination with the gluconic acid component increases the throwing power of the plating bath to thereby reduce the time of immersion necessary to develop a given plate thickness.

1 Claim, No Drawings

ELECTROLESS PLATING COMPOSITION

This application is a continuation-in-part of application Ser. No. 742,492 filed July 15, 1968, which in turn is a continuation-in-part of application Ser. No. 462,758, filed June 9, 1965, and now abandoned, which in turn is a continuation-in-part of application Ser. No. 374,845 filed June 12, 1964 and now abandoned.

BACKGROUND OF THE INVENTION

In conventional electroless plating processes, the base metal to be plated is immersed in a bath containing metal ions and the metal is plated on the base by what is believed to be chemical displacement. In addition to the metal ion concentration, the plating bath contains an acid or basic component and may also contain small amounts of a complexing or addition agent which aids in obtaining sound metallic deposits.

SUMMARY OF THE INVENTION

The present invention is directed to a method of surface treatment of a metallic base material and, in particular, to an improved method for electroless plating. In general, the electroless plating process consists of immersing the base metal to be plated in an aqueous solution containing a metal salt, a high concentration of a hydrolyzed carbohydrate and a gluconic acid component, such as gluconic acid, glucono delta lactone, or a water soluble gluconate. The combination of the high concentration of the carbohydrate and the gluconic acid component performs a function new in the art in that it substantially increases the throwing power or rate of deposition of the plating bath so that the time of immersion to develop a given plate thickness is substantially reduced over that of conventional processes.

The plating process of the invention can be used to plate a wide variety of metals and alloys on metallic bases, as well as plastic or ceramic materials. The process of the invention is particularly applicable to the plating of large metal surfaces, such as sheet steel, during mill production. Because of the high speed of deposition, the process can be used in continuous mill production without slowing down the sheet rolling operation. Moreover, the deposition time can be readily adjusted to a given mill production schedule.

The plating process of the invention can also be used to plate articles having irregular configurations, and a uniform thickness of the plating metal will be deposited on all surfaces, including recesses, exposed edges, and the like.

The plating process of the invention provides a plated coating which has excellent adherence to the base, and the luster or brightness of the plated coating can be readily varied for any desired application.

As a further feature of the invention, the basic composition or solution, without the addition of the metal salts, can be used to clean or sensitize the metallic base material prior to the electroless plating operation, or prior to the other surfacing coating operations.

DESCRIPTION OF THE PREFERRED EMBODIMENT

The base material to be plated can be a ferrous metal, such as carbon steel or stainless steel, or any other metal or alloy such as nickel, tin, copper, brass, aluminum, zinc, lead, tungsten, gold, beryllium, titanium, platinum, and the like. In addition, the process of the invention can be employed to plate ceramic materials as well as plastic materials, such as polyester, polystyrene, or ABS (acrylonitrile-butadiene-styrene) resins.

The plating bath is an aqueous solution containing water soluble metal salts, a hydrolyzed carbohydrate and an acid component selected from the group consisting of gluconic acid, glucono delta lactone, and water soluble salts of gluconic acid. The water soluble salts of gluconic acid may take the form of sodium gluconate, postassium gluconate, copper gluconate, sodium hepta gluconate, and the like. The gluconic acid component is used in a weight ratio of 1:0.25 to 1:4 with respect to the carbohydrate.

In some cases additional organic and/or inorganic acids may be employed in the plating bath along with the gluconic acid component to obtain special effects such as retarding or bringing up a particular color or tone, controlling the rate of deposition, etc. Organic acids, such as acetic, citric, tartaric, lactic, gluconic, formic, maleic, oxalic, adipic, sebacic, and the like, as well as the higher fatty acids containing up to 20 carbon atoms such as palmitic, stearic, lauric, and the like, can be used. Organic acids having substituent groups such as phenyl groups, as exemplified by carbolic acid and salicyclic acid, have also been used satisfactorily. Inorganic acids found suitable for use in the plating bath are boric, phosphoric, sulphuric, hydrochloric, nitric, and the like.

The concentration of acid to be used in the plating bath can be varied within wide limits depending on the speed of deposition required, the metal being plated, the bath temperature and other considerations. The total acid concentration is greater than 1 gram per 100 ml of the aqueous plating solution based on 100% concentration of the acid components, and preferably in a range of 1 to 50 grams per 100 ml of plating solution.

The plating bath also contains one or more of a wide variety of water soluble metal salts. The salts of metals such as aluminum, cadmium, cobalt, copper, lead, silver, gold, tin, zinc, magnesium, lithium, manganese, strontium and nickel have been used in the plating bath. Usually, the nitrate, sulfate, chloride or gluconate salts of the metals are employed and in some instances, a combination of metal salts, such as copper nitrate and nickel nitrate, have been used to produce special effects. In the case of plating alloys, the salts of the component metals are put into the bath. Examples are a copper-nickel alloy using copper chloride and nickel chloride in the bath. By using the chloride or sulfate salts, the resulting plating generalloy has a brighter luster, while using the nitrate salts results in a less bright surface condition. Copper is an exception, getting its brightest luster when copper nitrate is used in the bath.

The metal ion concentration of the plating bath can be as high as can be dissolved in the plating solution, and generally, a metal ion concentration of 10 to 80 grams per 100 ml of plating solution is preferred for most applications.

The specific metal ion concentration in the plating bath again depends on the rate of deposition required, the metal being plate, and other factors.

The plating bath also contains a substantial concentration of a water soluble, hydrolyzed carbohydrate. The carbohydrate can be added to the plating bath in a concentration greater than 5 grams per 100 ml of plating solution and up to its limit of solubility in the solution. For most applications a concentration of 5 to 80 grams per 100 ml of plating solution is employed, and preferably a concentration of 15 to 20 grams per 100 ml. The carbohydrate can be a monosaccharide, such as glycerose, dextrose, xylose, ribose, glucose, mannose, galactose, fructose, or the like, or a disaccharide, such as lactose, maltose, sucrose, or the like. In addition, polysaccharides can also be employed. Examples of polysaccharides which have proven satisfactory are dextrins, inulin, starches, starch derivatives, and the like. The carbohydrate is preferably an oligosaccharide which is defined as a compound that, on complete hydrolysis, gives one or more monosaccharides in relatively small numbers per molecule.

When added to the aqueous plating solution, the carbohydrate, over a period of time, will hydrolyze, and the hydrolyzation, it is believed, acts to shorten the effective length of the carbon chains in the carbohydrate and increase the Angstrom potential, thereby increasing the rate of deposition or throwing power of the plating bath. The time required to achieve hydrolyzation depends on various factors such as the quantity or volume of the bath, the concentration of the carbohydrate and the agitation of the bath. Large volumes, such as a 55 gallon drum may require a period, with agitation, of 48 hours to complete hydrolyzation of the carbohydrate. With smaller volumes hydrolyzation can be accomplished in 3 to 4 hours or more.

In the past, small amounts of carbohydrates have been added to electroless plating baths as thickening agents or to increase the soundness of the metallic deposits. Generally, the carbohydrates have been used in an amount less than 1 gram per 100 ml of plating solution. However, it has been found that by using a substantially larger concentration of hydrolyzed carbohydrate in combination with the gluconic acid, a different objective is achieved in that a substantial improvement in the rate of deposition or throwing power is achieved. It is believed that the gluconic acid component reacts with the carbohydrate to form a complex which is thought to be primarily responsible for the speed or rate of deposition.

It has been found that the rate of deposition of the metal ions can be further increased by adding to the plating solution a small amount, in the range of 0.001 to 0.1 grams per 100 ml of plating solution, of a material such as phytol, or guanylic acid. The increased rate of deposition when the carbohydrate is present is thought to be attributable to some interaction between the phytol or guanylic acid and the carbohydrate.

The plating bath can also contain a wetting agent. While not essential, the wetting agent can contribute benefits beyond wetting in that the agent also tends to prevent streaking, promotes adherence and enhances color of the plated metal. Many conventional wetting agents can be used and it has been found that modified ammonium alkyl sulfate (Orvus K liquid), sodium alky aryl sulfate (Orvus AB granules), and amine salts of dodecyl benzene sulphinic and phosphinic acids (Santomerse 1 ) have proven very satisfactory as the wetting agent. The wetting agent is employed in a concentration of 0.05 to 35 grams per 100 ml of the plating solution and preferably in the range of 0.05 to 2.0 grams per 100 ml of solution.

The pH of the plating bath is not particularly critical and can vary from a value of less than 0.5 up to 7.0 depending on the components of the plating bath. Generally, for most applications the pH will be in the range of 1 to 4. When using an acid anhydride, such as glucono delta lactone, as the acid component of the aqueous solution, an alkaline pH may be momentarily obtained until the anhydride has fully hydrolyzed to form the acid.

It has been found that the temperature of the plating bath can vary over wide limits and the plating process has been carried out at temperatures in the range of −15° C to + 45° C. Generally, the process is carried out with the plating bath at room temperature.

The base material should be cleaned and degreased prior to immersion in the plating bath. Conventional cleaning, degreasing and deoxidizing procedures can be employed. For example, the base can be degreased with a solvent such as alcohol, trichloroethylene or any conventional alkaline degreaser, then dipped in an acid bath, such as hydrochloric or sulphuric acid bath, and water rinsed.

In some cases, where the base metal may be overly sensitive to the acid or pickling bath of conventional cleaning techniques, the base metal is initially subjected to the action of a sensitizing or cleaning bath before being immersed in the plating bath. The sensitizing bath is a water solution similar in composition to the plating solution but without the addition of the metal salts. The sensitizing bath utilizes the gluconic acid component, i.e. gluconic acid, or the anhydride, glucono delta lactone, or water soluble salts of gluconic acid such as sodium gluconate, potassium gluconate, copper gluconate, sodium hepta gluconate, and the like, and if an additional acid is used in the plating bath, that acid can also be used in the sensitizing bath although it is not essential.

The total concentration of the acid in the sensitizing bath can vary within wide limits, and generally, as in the case of the plating bath, the acid has a concentration greater than 1 gram per 100 ml and generally in the range of 1 to 50 grams per 100 ml, with these figures being based on 100% concentration of the acid.

The carbohydrate used in the sensitizing bath is similar to the carbohydrate used in the subsequent plating bath. The carbohydrate is employed in the sensitizing bath in a concentration greater than 5 grams per 100 ml of solution and up to its limit of solubility and preferably in the range of 5 to 40 grams per 100 ml of the sensitizing solution. When the sensitizing treatment is employed prior to the electroless plating, the carbohydrate in the sensitizing bath provides "drag in" for the plating bath. As the base metal can be transferred directly to the plating bath, while wet, some of the carbohydrate from the sensitizing bath will be carried into the plating bath and the concentration of the carbohydrate in the sensitizing bath is maintained so that the amount "dragged in" will approximate and replenish that lost in the plating bath.

A wetting agent, similar to that described with respect to the plating solution, can be used in an amount of 0.05 to 35 grams per 100 ml of the sensitizing solution and preferably in the range of 0.05 to 2.0 grams per 100 ml.

The pH of the sensitizing bath, as in the case of the plating bath, can vary from a value of less than 0.5 up to 7.0, depending on the acid used and the concentration. The temperature of the sensitizing bath can vary from −15° to +45° C, with room temperature being preferred.

The sensitizing or cleaning treatment has application of use other than in conjunction with the electroless plating operation. For example, the sensitizing treatment can be used to clean metal prior to the application of other surface coverings, such as paint or ceramic enamel, or to clean metal prior to brazing, welding or adhesive bonding.

In carrying out the electroless plating process of the invention, the base to be plated is cleaned and degreased with a solvent such as alcohol, toluene, trichloroethylene, or any conventional alkaline degreasing agent. The clean base is then immersed and agitated in the sensitizing bath with the time of immersion depending on the concentration of the ingredients. With a relatively concentrated sensitizing bath, the base may be immersed in the solution for a period of only a few seconds. With a dilute sensitizing solution, the time of the immersion can be up to 1½ to 2 minutes. Generally, with a relatively concentrated sensitizing solution, a 30 second maximum time of immersion is maintained. Rather than immersing the base in the sensitizing solution, the solution can be sprayed or brushed on the surface of the base or applied to the base in any desired manner. Alternately, the base can be subjected to a standard acid dip in place of the sensitizing bath.

The base material is then immersed and agitated in the plating bath, or alternately the solution is flowed over the base material, to provide relative movement between the solution and the base material for a period of time sufficient to build up the desired plate thickness. For most applications, the time of immersion is approximately 1 minute, but this time can vary depending upon the desired thickness of plate, the concentration of the plating solution, the temperature, and the nature of the base and plating metal.

After the desired thickness of plating metal has been built up on the base material, the plated material is removed from the bath and rinsed to complete the process. As in the case of the sensitizing solution, the plating solution can be sprayed or brushed on the base rather than immersing the base in the plating solution.

The substantial concentration of hydrolyzed carbohydrate in the plating bath is important in providing the improved rate of metal deposition. By varying the amount of the carbohydrate in the plating bath, the rate of deposition can be regulated as desired. This is particularly important when the process is used in conjunction with a sheet metal rolling mill so that the plating process can be timed in synchronization with the rolling schedule of the mill.

The plated coating has excellent adherence to the base material and will not crack or peel from the base when the article is bent 180° according to ASTM test procedures.

The process of the invention permits a wide variety of metals and alloys to be plated onto either a metal base or plastic or ceramic materials. For example, with the process of the invention, aluminum can be plated on steel, copper can be plated on titanium, gold can be plated on silver or platinum, copper can be plated on lead, and silver can be plated on beryllium. In the latter plating procedure, it is normally necessary to initially plate the beryllium base with several thin coats of copper by quickly dipping the beryllium into the copper plating bath and rinsing to build up several thicknesses of copper. The copper coated beryllium is then placed in the plating bath containing silver salts to provide a silver coating on the beryllium base.

The following examples illustrate the manner in which the invention can be carried out:

EXAMPLE I

A 1 inch × 4inch × 3/32inch strip of SAE 1010 steel was immersed in a sensitizing bath consisting of 50 grams of glucono delta lactone, 50 grams of sucrose, 2.5 grams of Orvus K and 50 grams of water. The bath had been prepared 24 hours prior to use to hydrolyze the carbohydrate and had a temperature of 20° C and a pH of 2.5. The steel strip was agitated in the sensitizing bath for a period of 20 seconds and was subsequently, while still wet, immersed and agitated in a plating bath which was composed of 87 grams of the above-mentioned sensitizing solution, 15 grams of hydrolyzed sucrose, 35 grams of copper nitrate and 25 grams of water. The pH of the plating bath was 1.5 and the temperature of the bath was 20° C.

The steel strip was maintained in the plating bath for a period of 1 minute and a coating of copper 0.0010 inch thick was deposited during this period.

The resulting copper coating was uniformly distributed without pits or porosity and had a high luster.

EXAMPLE II

A steel strip similar in size and composition to that of Example I was immersed on a sensitizing solution consiting of 122.5 grams of 50% solution of gluconic acid, 130 grams of sucrose, 2.5 grams of Orvus K, 100 grams of oxalic acid and 500 grams of water. The bath was permitted to stand 24 hours without agitation prior to its use to hydrolyze the carbohydrate. The pH of the sensitizing bath was 1.5 and the temperature of the bath was 20° C. The steel strip was maintained in the sensitizing solution for a period of 20 seconds and then withdrawn and immediately immersed in a plating bath which was composed of 84.65 grams of the sensitizing solution of this example, 25 grams of copper nitrate, 20 grams of nickel nitrate and 50 grams of water. The steel was maintained in this bath for a period of 1 minute and a coating of high luster copper was deposited on the steel.

The resulting copper coating was uniform in thickness, free of pores, and pits, was highly resistant to corrosion and finger marking.

EXAMPLE III

The steel strip similar to that described in Example I was immersed in a sensitizing solution consisting of 22.5 grams of 50% gluconic acid, 20 grams of fructose, 2.5 grams of Orvus K, 300 grams of phosphoric acid and 597.5 grams of water. The sensitizing bath had a pH of less than 1.0 and a temperature of 20° C. The steel strip was agitated in the bath for a period of 20 seconds and then directly immersed and agitated in a plating bath consisting of 82.8 grams of the sensitizing solution of this example, 18 grams of copper nitrate, 20 grams of water and 0.01 grams of phytol. The plate was maintained in the plating bath for a period of 60 seconds and a uniform high luster copper coating was deposited during this period.

EXAMPLE IV

A beryllium rod was agitated in the following sensitizing bath for 20 seconds:

| | |
|---|---|
| gluconic acid (50 % solution | 122.5 gr. |
| sucrose | 130.0 gr. |
| Orvus K | 2.5 gr. |
| boric acid | 50.0 gr. |

-continued

| | |
|---|---|
| water | 900.0 gr. |

In preparing the above solution, the boric acid was initially dissolved in 500 ml. of warm water and this solution was mixed with the other ingredients and with the balance of the water. The solution was agitated for 8 hours prior to use to hydrolyze the sucrose.

Following the sensitizing treatment, the beryllium rod was immersed in a plating solution until hydrogen was at the point of being evolved and the rod was immediately removed from the solution and plunged in cold water. The plating solution had the following composition:

| | |
|---|---|
| sensitizing bath formulation of this Example | 59.5 gr. |
| copper sulfate | 35.0 gr. |
| water | 50.0 gr. |

This procedure of immersing the rod in the plating solution and plunging it in cold water was repeated 25 times to build up a coating of copper on the beryllium rod.

The copper plated rod was then immersed and agitated for 60 seconds in a plating bath having the following composition:

| | |
|---|---|
| sensitizing bath formulation of this Example | 59.5 gr. |
| silver nitrate | 35.0 gr. |
| water | 50.0 gr. |

The rod was removed from the silver plating bath and was observed to have an adherent uniform coating of silver.

EXAMPLE V

A steel strip was cleaned and subsequently immersed and agitated for 60 seconds in a plating solution having the following composition:

| | |
|---|---|
| sensitizing solution formulation of EXAMPLE I | 119 gr. |
| stannous nitrate | 30 gr. |
| copper nitrate | 30 gr. |

The resulting plated coating was a tin-copper alloy.

EXAMPLE VI

A series of steel strips were plated following treatment in the sensitizing bath of Example III by using a plating bath having the following general composition:

| | |
|---|---|
| sensitizing bath formulation of Example III | 87 gr. |
| metal salt | 35 gr. |

-continued

| | |
|---|---|
| water | 25 gr. |

The plating bath was agitated for 8 hours prior to use to hydrolyze the sucrose. The metal salts used were the nitrates, and in most cases, the sulfates and chlorides of cadmium, copper, nickel, tin, zinc, silver, and lead, and in each case the strip was agitated in the plating bath for 60 seconds. The thickness of the plated coatings deposited through use of the various plating solutions were as follows in inches:

| | Nitrate | Sulfate | Chloride |
|---|---|---|---|
| cadmium | .00411 | .00221 | .00610 |
| copper | .00100 | — | — |
| nickel | .00129 | .00128 | .00123 |
| tin | .00226 | .00172 | .00149 |
| zinc | .00350 | .00398 | .00283 |
| silver | .00281 | — | — |
| lead | .00222 | — | — |

EXAMPLE VII

A 1inch × 4 inch × 3/32inch strip of aluminum was sprayed with a sensitizing solution consisting of 50 grams of Dextrin 7071 (dextrin sold by Corn Products Co.), 55 grams of sodium gluconate, 2.5 grams of Orvus K and 50 grams of water. The solution was agitated for several hours to hydrolyze the carbohydrate. The sensitizing solution had a temperature of 20° C and a pH of 2.5. After 60 seconds a plating solution composed of 87 grams of the above-mentioned sensitizing solution, 15 grams of Dextrin 7071, 35 grams of lead nitrate and 25 grams of water was sprayed on the strip. The plating solution had previously been agitated for a period of time sufficient to hydrolyze the carbohydrate. The pH of the plating solution was about 1.5 and the temperature of the solution was 20° C.

After an exposure of 60 seconds the strip was rinsed with tap water. The resulting lead coating had a thickness of 0.0010 inch and was free of pits and porosity.

Various modes of carrying out the invention are contemplated as being within the scope of the following claims particularly pointing out and distinctly claiming the subject matter which is regarded as the invention.

I claim:

1. An electroless plating solution for plating a base material, consisting essentially of a water solution having dissolved therein, a water soluble metal salt, an acidic component selected from the group consisting of gluconic acid, glucono delta lactone, and water soluble salts of gluconic acid, and a water soluble hydrolyzed carbohydrate, said carbohydrate being present in a concentration greater than 5 grams per 100 ml of said solution and said solution having pH in the range of 0.5 to 7.0 said solution also including from .001 to 0.1 grams per 100 ml of solution of a substance selected from the group consisting of phytol and guanylic acid.

* * * * *